US011940254B2

(12) United States Patent
Robbins et al.

(10) Patent No.: US 11,940,254 B2
(45) **Date of Patent: *Mar. 26, 2024**

(54) LOW DRAG, HIGH DENSITY CORE PROJECTILE

(71) Applicant: Barnes Bullets, LLC, Mona, UT (US)

(72) Inventors: Jason Wesley Robbins, Salem, UT (US); Carl Carter, Pleasant Grove, UT (US); Christopher Creed Crosby, Nephi, UT (US); Gregory S. Christensen, Fairview, UT (US); Mitchell Dean Kukson, Nephi, UT (US); Brian James Simons, Mount Pleasant, UT (US); Greggory Sloan, Fountain Green, UT (US); Michael Painter, Nephi, UT (US)

(73) Assignee: Barnes Bullets, LLC, Mona, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/861,979

(22) Filed: Jul. 11, 2022

(65) Prior Publication Data

US 2023/0131262 A1 Apr. 27, 2023

Related U.S. Application Data

(63) Continuation of application No. 17/360,331, filed on Jun. 28, 2021, now Pat. No. 11,408,717.

(51) Int. Cl.

| | |
|---|---|
| ***F42B 12/74*** | (2006.01) |
| ***F42B 12/34*** | (2006.01) |
| *F42B 10/46* | (2006.01) |

(52) U.S. Cl.
CPC ..... *F42B 12/74* (2013.01); *F42B 12/34* (2013.01); *F42B 10/46* (2013.01)

(58) Field of Classification Search
CPC ..... F42B 12/34; F42B 12/745; F42B 12/74
See application file for complete search history.

(56) References Cited

U.S. PATENT DOCUMENTS 2,322,751 A 6/1943 Studler
3,142,256 A 7/1964 Mack
(Continued)

FOREIGN PATENT DOCUMENTS

EP 0225532 A1 6/1987

*Primary Examiner* — J. Woodrow Eldred
(74) *Attorney, Agent, or Firm* — WOMBLE BOND DICKINSON (US) LLP

(57) ABSTRACT

A projectile designed to be lead-free and have a ballistic coefficient ranging from about 0.13 to about 0.80 or greater for enhanced energy/performance at extended ranges may have an elongated body formed with a jacket including a wall having an end defining an ogive portion and a cavity or recess defined within the jacket and in which a core is received. The projectile can be configured in various calibers and sizes. The projectile core may be formed from a plurality of core sections, and at least one of the plurality of core sections may include tungsten powder and a lead-free binder material pressed together to form a substantially cylindrical shape or compact. One or more of the core sections further can be sintered, and the one or more core sections may be received in an end-to-end relationship within the cavity defined by the jacket to form a stacked, sectional core.

34 Claims, 7 Drawing Sheets

(56) References Cited

U.S. PATENT DOCUMENTS

| | | | |
|---|---|---|---|
| 3,311,962 | A | 4/1967 | Burns, Jr. |
| 3,349,711 | A | 10/1967 | Darigo et al. |
| 3,881,421 | A | 5/1975 | Burczynaski |
| 3,890,902 | A | 6/1975 | Travor et al. |
| 3,913,489 | A | 10/1975 | Travor et al. |
| 4,044,679 | A | 8/1977 | Pagano et al. |
| 4,108,073 | A | 8/1978 | Davis |
| 4,336,756 | A | 6/1982 | Schreiber |
| 4,352,225 | A | 10/1982 | Schreiber |
| 4,517,897 | A | 5/1985 | Kneubühl |
| 4,550,662 | A | 11/1985 | Burczynski |
| 4,776,279 | A | 10/1988 | Pejsa |
| 4,793,037 | A | 12/1988 | Carter |
| 4,856,160 | A | 8/1989 | Habbe et al. |
| 4,878,434 | A | 11/1989 | Sommet |
| 4,947,755 | A | 8/1990 | Burczynski |
| 5,131,123 | A | 7/1992 | Brooks |
| 5,160,805 | A | 11/1992 | Winter |
| 5,357,866 | A | 10/1994 | Schluckebier et al. |
| 5,385,100 | A | 1/1995 | Corzine et al. |
| 5,385,101 | A | 1/1995 | Corzine et al. |
| 5,686,693 | A | 11/1997 | Jakobsson |
| D389,221 | S | 1/1998 | Borg |
| 6,119,600 | A | 9/2000 | Burri |
| 6,213,022 | B1 | 4/2001 | Pullman |
| 6,244,187 | B1 | 6/2001 | Head |
| 6,530,328 | B2 | 3/2003 | Burczynski et al. |
| 6,805,057 | B2 | 10/2004 | Carr et al. |
| 6,973,879 | B1 | 12/2005 | McElroy et al. |
| 7,150,233 | B1 | 12/2006 | Eberhart |
| 7,210,411 | B2 | 5/2007 | Booth et al. |
| 7,322,297 | B2 | 1/2008 | Yaich |
| 7,475,636 | B2 | 1/2009 | O'Dwyer et al. |
| 7,543,535 | B2 | 6/2009 | Herrlinger |
| 7,748,325 | B2 | 7/2010 | Marx |
| D621,468 | S | 8/2010 | Nilsson |
| 7,874,253 | B2 | 1/2011 | Marx |
| 7,891,298 | B2 | 2/2011 | Minick et al. |
| 8,109,212 | B2 | 2/2012 | O'Dwyer |
| 8,117,967 | B2 | 2/2012 | Salvel |
| 8,161,885 | B1 | 4/2012 | Emary |
| 8,171,852 | B1 | 5/2012 | Rebar |
| 8,186,277 | B1 | 5/2012 | King |
| 8,256,352 | B2 | 9/2012 | Masinelli |
| 8,397,641 | B1 | 3/2013 | Jackson |
| 8,448,575 | B2 | 5/2013 | Goddard |
| 8,511,233 | B2 | 8/2013 | Nilsson |
| 8,640,589 | B2 | 2/2014 | Dryer et al. |
| 8,646,389 | B2 | 2/2014 | Masinelli |
| 8,950,333 | B2 | 2/2015 | Burczynski et al. |
| 9,046,333 | B2 | 6/2015 | Masinelli |
| 9,188,414 | B2 | 11/2015 | Burczynski |
| 9,366,512 | B2 | 6/2016 | Burczynski et al. |
| 9,366,513 | B1 | 6/2016 | Burczynski et al. |
| 9,534,876 | B2 | 1/2017 | Silvers |
| 10,001,355 | B2 | 6/2018 | Peterson |
| 10,036,619 | B2 | 7/2018 | Fricke et al. |
| 10,330,447 | B2 | 6/2019 | Burscynski |
| 10,401,105 | B2 | 9/2019 | Dowling et al. |
| 10,684,108 | B2 | 6/2020 | Peterson et al. |
| 10,760,882 | B1 | 9/2020 | Burrow |
| 10,801,820 | B2 | 10/2020 | Peterson |
| 11,067,370 | B2 | 7/2021 | Imhoff et al. |
| 11,079,205 | B2 | 8/2021 | Burrow et al. |
| 11,085,742 | B2 | 8/2021 | Burrow |
| 11,408,717 | B2 * | 8/2022 | Robbins ..... F42B 12/34 |
| 2002/0020324 | A1 | 2/2002 | Burczynski et al. |
| 2005/0183617 | A1 | 8/2005 | MacDougall |
| 2006/0027128 | A1 | 2/2006 | Hober |
| 2007/0204758 | A1 | 9/2007 | Spatz et al. |
| 2008/0035008 | A1 | 2/2008 | Riess et al. |
| 2009/0288572 | A1 | 11/2009 | Sauvestre |
| 2011/0088537 | A1 | 4/2011 | Eberhart |
| 2011/0252997 | A1 | 10/2011 | Hoffman |
| 2013/0086834 | A1 | 4/2013 | Battaglia |
| 2014/0261044 | A1 | 9/2014 | Seecamp |
| 2014/0283707 | A1 | 9/2014 | Reiss |
| 2020/0033102 | A1 * | 1/2020 | Burrow ..... F42B 12/58 |
| 2021/0341275 | A1 | 11/2021 | Robbins et al. |

* cited by examiner

LOW DRAG, HIGH DENSITY CORE PROJECTILE

CROSS REFERENCE TO RELATED APPLICATION

The present application is a continuation of co-pending U.S. patent application Ser. No. 17/360,331, filed Jun. 28, 2021, which claims the benefit of previously filed, U.S. Provisional Patent Application No. 63/017,129, filed Apr. 29, 2020.

INCORPORATION BY REFERENCE

The specification and drawings of U.S. patent application Ser. No. 17/360,331, filed Jun. 28, 2021 and U.S. Provisional Patent Application No. 63/017,129, filed Apr. 29, 2020, are specifically incorporated herein by reference as if set forth in their entirety.

TECHNICAL FIELD

The present disclosure relates to projectiles, and more particularly, to a low drag, high density core projectile for firearms. Other aspects also are described.

BACKGROUND

Hunters and shooters frequently encounter and target game and targets at distances of 100 yards or more, and with more modern higher power sporting rifles, may target game or targets upwards of 700 to 1,000 yards. As a result, more efficient and modern projectiles generally are required for achieving desired accuracy and terminal performance when hunting or shooting at such ranges. However, conventional long range projectiles designed to achieve higher retained energy at longer ranges may penetrate and pass through a targeted animal without causing a wound sufficient to substantially immediately incapacitate or kill the animal, resulting in the targeted animal surviving and possibly suffering in a mortally wounded condition for an extended period of time. Accordingly, it can be seen that a need exists for providing a projectile that may address the foregoing and other related, and unrelated, issues and/or problems.

SUMMARY

In view of the foregoing, in one aspect, the present disclosure is directed to projectiles, including projectiles of varying calibers, for hunting game and shooting targets at longer ranges, which enables a higher ballistic coefficient and enhanced terminal performance to provide a substantially more immediate and humane killing effect.

In some embodiments, the projectiles according to the present disclosure will include a projectile designed to be lead-free (e.g., substantially or completely lead-free), and with a ballistic coefficient ranging from about 0.13 to about 0.80 or greater (e.g., from about 0.50 to about 0.70 or greater), depending on the diameter and weight of the projectile, for enhanced energy/performance at extended ranges. The projectile further will have a substantially consistent and enhanced terminal performance at ranges within about 100 yards or less, and up to approximately 900 to 1,000 yards, and possibly greater.

The projectile will have an elongated body that can be formed with a jacket including a wall having a first end defining an ogive portion, a second end opposite the first end, and a cavity or recess defined within the jacket and in which a core is received. As noted, the projectile can be configured in various calibers and sizes. In some embodiments, the projectile can be formed in a boat-tail configuration, though other shapes/configurations also can be used, such as forming the second end or base of the bullet body with a substantially flat or beveled end.

The projectile core may be formed from a plurality of core sections. In some aspects, at least one of the plurality of core sections may include tungsten powder and a lead-free binder material pressed together to form a substantially cylindrical shape or compact. In some embodiments, the lead-free binder material may be polymer-free. Each of the core sections further can be sintered. The core sections may be received in an end-to-end relationship within the cavity defined by the jacket to form a stacked, sectional core. In some aspects, the core may be a single unitary component, either before or after sintering and/or before or after swaging.

In addition, a forward facing or first end or side of one or more of the core sections can be scored, cut, imprinted or otherwise formed with one or more weakening features. For example, the front end of the core section proximate the ogive portion of the projectile can be scored or cut, such as along or across a generally central part thereof. The scoring or other weakening feature(s) formed into the core section(s) helps create a large wound cavity upon entry into targeted game, followed by creation of a plurality of smaller wound channels resulting from at least one of the core sections fragmenting and/or from at least one of the core sections separating from other core sections.

According to an additional aspect, the projectile may be received within a casing. The casing may be a shell casing, for example, for use with center-fire shells, rim-fire shells, shot shells, etc. The casing can be formed with a bottle-necked configuration or can be a substantially straight-walled casing. The casing further generally will have a first, rear end or base in which a primer will be received, and a second, open front end in which the projectile is received. A propellant powder will also be received within the casing, in a chamber defined within the casing and behind the projectile. In embodiments, the projectile may be used without a casing, for example, for use in muzzleloaders, air guns, etc.

According to still another aspect, the present disclosure further is generally directed to a method for making a projectile. The projectile will be formed with a high density, lead-free core (e.g., a substantially or completely lead-free core), providing low drag with a high ballistic coefficient, enhanced energy transfer and terminal performance at closer ranges (e.g., 100 yards or less), as well as at extended ranges of upwards of about 900 to 1,000 yards or greater, depending on the projectile and/or cartridge. In some embodiments, the projectile may have a ballistic coefficient ranging from about 0.13 to about 0.80 or greater (e.g., from about 0.50 to about 0.70 or greater, or of at least about 0.72, for example, for a projectile having a 6.5 millimeter diameter).

In one aspect, the method includes providing tungsten powder and a lead-free binder material to form a core mixture and pressing the core mixture into a plurality of compacted core sections. In some embodiments, the lead-free binder material may be in the form of powder, and the tungsten powder and the lead-free binder material powder may be mixed together. In some embodiments, the mixture may include at least some of the tungsten powder particles at least partially coated with the lead-free binder material. The method may further include the addition of a lubricant material (e.g., a lubricant powder or other lubricant material)

to the compacted core sections. The plurality of core sections generally will be sintered and the sintered core sections placed into a jacket of the projectile. The method may also include swaging the cores while inside the jacket and compressing at least one of the plurality of core sections into a final core section shape.

Still further, another aspect of the method can include cutting, scoring or otherwise forming a weakening feature within an end of one or more of the plurality of core sections. For example, the first or front end of a forward-most one of the core sections can be formed with a cut or series of cuts or score lines that will weaken the core section, and help facilitate its fragmentation, which in turn, can help facilitate the splitting apart or separation of the series of core sections upon impact.

These and other advantages and aspects of the embodiments of the disclosure will become apparent and more readily appreciated from the following detailed description of the embodiments and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable under certain circumstances. Thus, the following description is provided as illustrative of the principles of the embodiments of the invention and not in limitation thereof, since the scope of the invention is defined by the claims.

Figure 1:
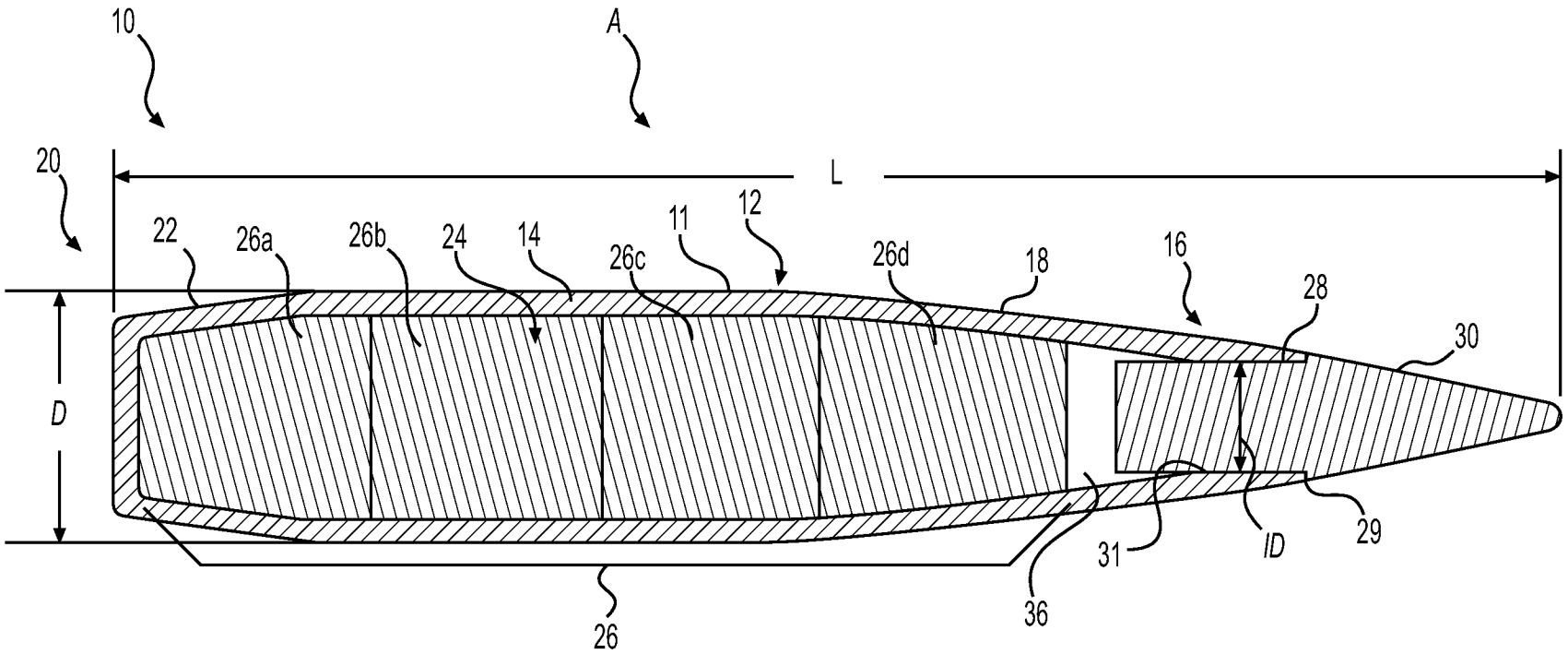
FIG. 1 is a schematic section view of an example embodiment of a projectile according to an aspect of the present disclosure.
Figure 9:
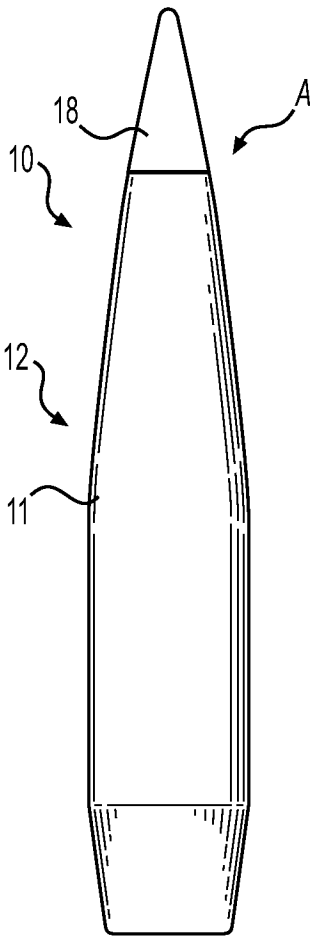
FIG. 9 is a side view of the projectile shown in FIG. 8.
Figure 10:
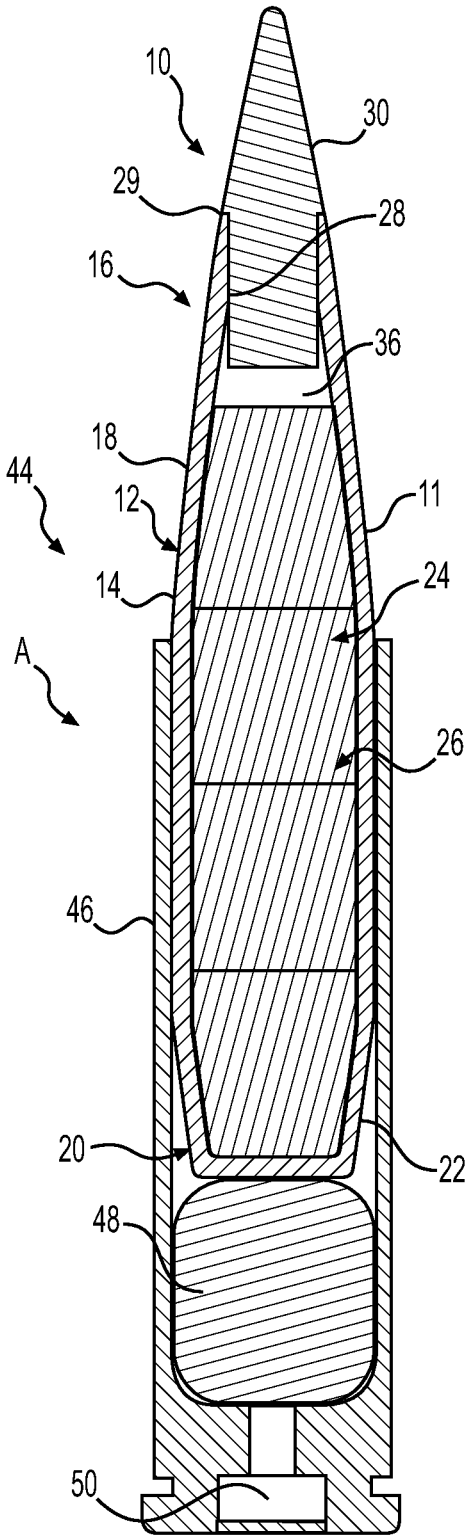
FIG. 10 is a side section view of an embodiment of an ammunition cartridge including the projectile shown in FIG. 1.

As generally shown in FIGS. 1, 9, and 10, the present disclosure is directed to projectiles "A" with higher performance characteristics and capabilities, and in particular, to projectiles with match-grade accuracy characteristics and lethal performance characteristics at close ranges (e.g., ranges of about 100 yards or less) and extended ranges (e.g., ranges of upwards of about 700 to 900 yards or greater). The projectiles will include a low drag, high density core projectile 10 that will be formed from lead-free materials (e.g., substantially or completely lead-free materials), with sufficient density (e.g., a core density greater than about 12 grams per cubic centimeter) to achieve a high ballistic coefficient and which projectiles can be fired using rifles with standard barrels, with conventional twists, rather than requiring customized barrels/rifles.

In one example embodiment shown in FIG. 1, the projectile 10 can include an elongated body 11 including a jacket 12 having a wall 14, a first end 16 with an ogive portion 18 proximate the first end 16, and a second end 20 opposite the first end 16. The bullet body 11 may be substantially cylindrical, except as otherwise indicated herein. For example, the second end 20 of the projectile 10 shown in FIG. 1 can be formed with a boat tail 22, although it also can include a substantially flat or a beveled end portion. The jacket 12 further typically will be formed from a malleable metal material, e.g., copper or a copper alloy. Other, similar materials further are contemplated.

In the example embodiment shown in FIG. 1, the projectile 10 also includes a core 24 formed from a plurality of core sections 26. Although the example shown in FIG. 1 includes four core sections 26*a*-26*d*, other numbers of core sections 26 are contemplated, such as fewer or more core sections 26. At least one of the plurality of core sections 26*a*-26*d* may include a high density material. For example, one or more of the core sections 26 may include tungsten powder and a lead-free binder material pressed to form a substantially cylindrical shape or compact. Some examples of the core sections 26 also may include a binder or lubricant material, such as a lithium stearate powder or other, similar lubricant or binding agent, mixed with the tungsten powder and lead-free binder material pressed into the substantially cylindrical shape of the core sections 26.

In some embodiments, the lead-free binder material may be substantially polymer-free, and in some embodiments at least some of the tungsten powder particles may be at least partially coated with the lead-free binder material, for example, forming a mixture of the particles. In some embodiments, the lead-free binder material may include one or more other materials having a melting temperature lower than tungsten, such as copper, aluminum, tin, nickel, zinc, iron, gold, silver, carbon steel, alloyed steel, stainless steel, antimony, etc., or a mixture or alloy of such materials, and/or brazing filler materials, such as silicon, boron, phosphorus, palladium, cobalt, cadmium, bismuth, beryllium, chromium, manganese, molybdenum, indium, carbon, germanium, mischmetal, cerium, strontium, lithium, zirconium, hafnium, vanadium, sulfur, or titanium. In some embodiments, the lead-free binder may be in powder form.

Figure 4:
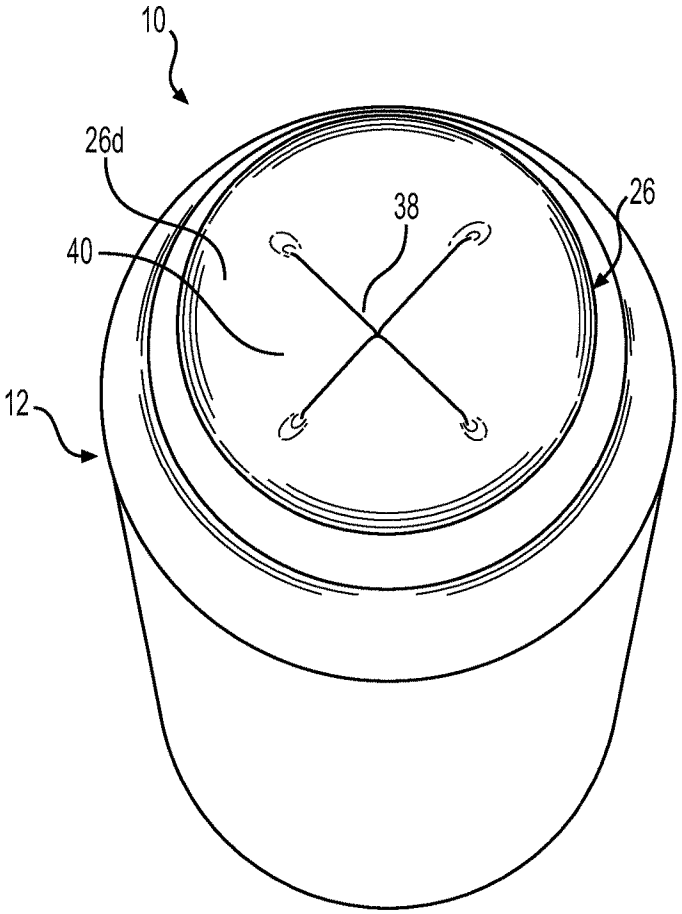
FIG. 4 shows a perspective view of an end of the face of one of the core sections including example scoring lines or weakening feature(s) formed therein.
Figure 5B:
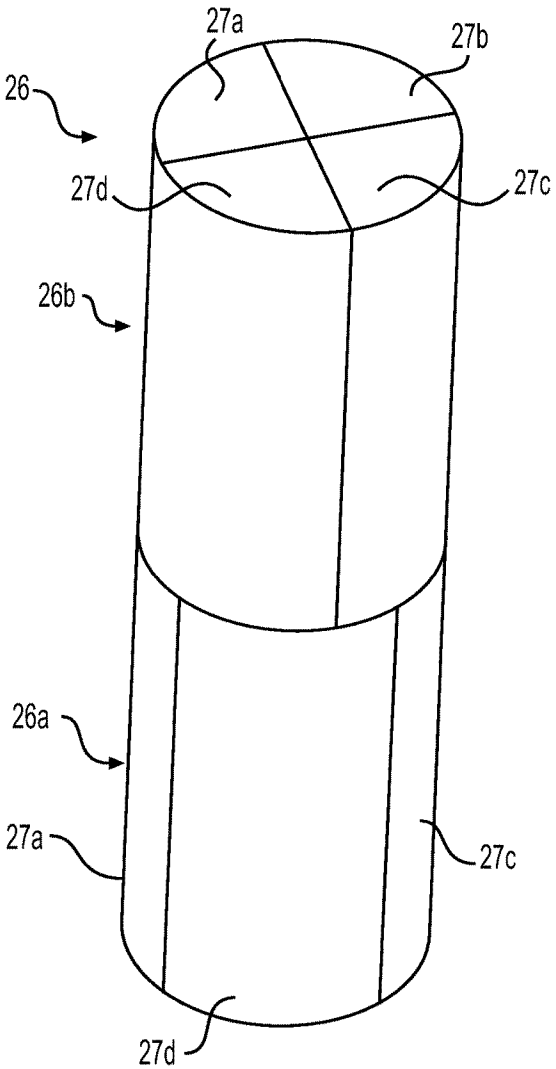
FIG. 5B shows a perspective view of another example core sections, each including a plurality of core sectors according to embodiments of the disclosure.
Figure 5A:
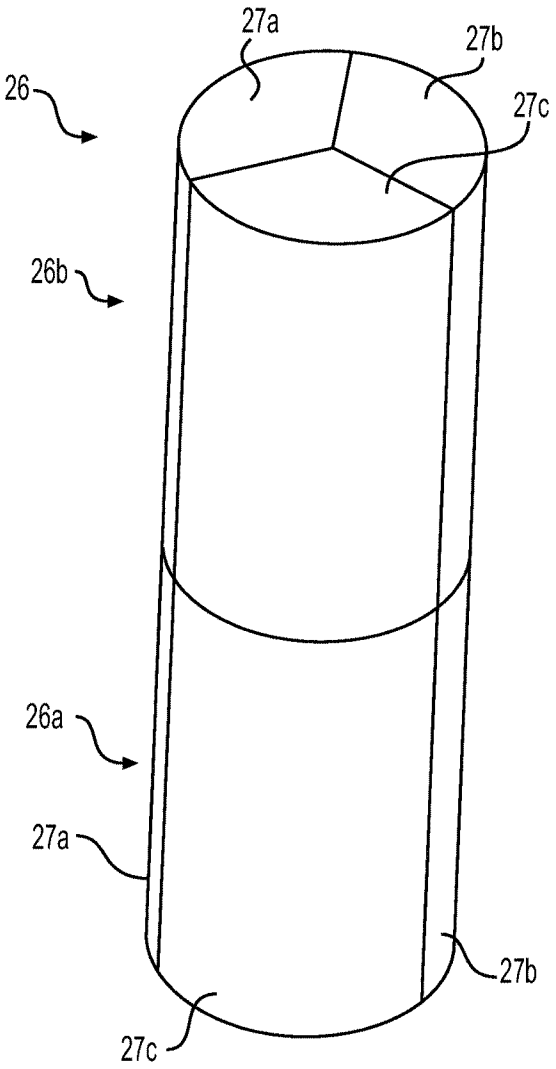
FIG. 5A shows a perspective view of core sections, each including a plurality of core sectors according to embodiments of the present disclosure.

As shown in FIG. 1, the core sections 26 generally will be received in an end-to-end or stacked relationship, received in a central recess or cavity 36 defined within the jacket 12 to form the core 24. As explained with respect to FIG. 4, an end face and or along the side of at least one of the core sections 26, for example, the end face of the first or forward-most core section 26*d* proximate the ogive portion 18 of the projectile 10, may be scored or cut, forming pattern or weakened areas, such as an "X"-shaped cut or crossed score lines in the end face of the core section 26 as shown in FIGS. 4 and 5B, or other pattern such as pie-shaped sections as shown in FIG. 5A. Such scores, cuts, or other weakened areas help facilitate the breaking apart or fragmentation of the core section 26, as well as the separation and redirection of one or more of the stacked core sections along separate paths sufficient to create additional wound channels upon impact and/or result in a more rapid energy transfer.

In some embodiments, the jacket 12, with the stacked core sections 26 therein, will be swaged to form the ogive portion 18. Such swaging of the jacket 12 may also serve to compress one or more of the core sections 26, so as to help increase the density of the core 24 and/or so that the core sections 26 form the final cross-sectional shape of the core 24, as shown in FIG. 1, for example, and as explained herein with respect to FIGS. 2-9.

Figure 8:
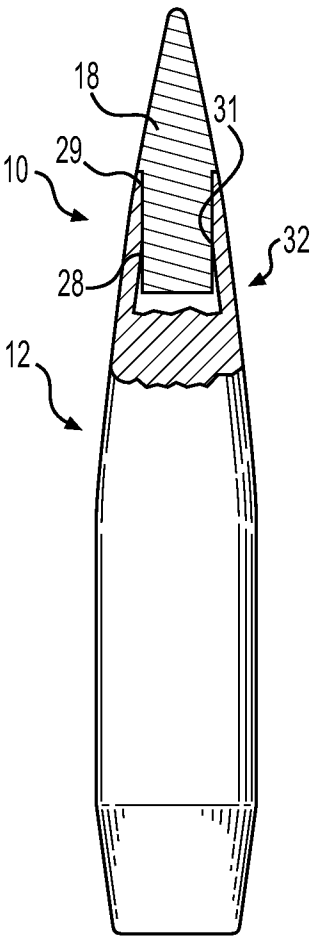
FIG. 8 is a partial section view of the projectile shown in FIG. 7, showing a jacket mouth and a jacket meplat of the jacket formed around a tip at a first or forward end of the projectile.

As also shown in the embodiment of FIG. 1, a jacket meplat 29 can be formed during swaging, and in some examples, the projectile 10 also may include a tip 30. The tip 30, in some embodiments, can include a separate tip structure that can be received within a jacket mouth 28 forming a forward tip cavity 31 defined in the first end of the bullet body 11, as indicated in FIGS. 1 and 8. The tip 30 serves to help reduce the aerodynamic drag of the projectile 10 and increase the ballistic coefficient. The tip 30 may be formed from various polymer or plastic materials, or other, similar materials, including at least some metal materials.

As explained in more detail herein, at least some examples of the projectile 10 may result in a low drag, high density projectile that is accurate at ranges up to at least about 900 yards and that results in a wound that effectively incapacitates game upon impact. For example, the projectile 10 has a high density core and shape that results in a relatively high ballistic coefficient of at least about 0.13 to about 0.80 or greater (e.g., at least about 0.70 to about 0.72) (G1 ballistic coefficient), which may result in improving the accuracy of the projectile 10 for long-range targeting. In some embodiments, the projectile 10 may be configured such that the ballistic coefficient is at least about 0.75, at least about 0.80, or at least about 0.85.

The projectile 10 further may be sized and configured based on any intended caliber, such as, but not limited to, calibers ranging from 0.204 inches to 0.510 inches. For example, the projectile can be configured for various hunting and/or military cartridges, including, but not necessarily limited to bullet diameters of 0.224, 0.243, 0.257, 0.264/6.5 mm, 0.277, 0.284/7 mm, 0.308, and 0.338. Those skilled in the art will understand and appreciate that various other calibers also can be provided. Still further, projectile weights for the projectile 10 can vary depending on caliber and/or size, for example, ranging from about 90 to about 95 to about 105 grains from smaller calibers, such as 0.224 to 0.243, up to about 220 to 230 grains or larger for larger calibers, such as 7 mm, and 0.308.

In addition, an outer diameter D of the projectile 10, the length L of the projectile 10 including the tip 30, and/or an inner diameter ID of portions of the bullet body, including the jacket meplat 29 and ogive portions 18, as well as the boat tail 22 and the length of the core 24, may be configured to at least partially provide the desired enhanced/increased ballistic coefficient. In one example embodiment, the diameter D may be 0.264 inches, the length L may be 1.522 inches, the inner diameter ID of the jacket mouth 28 may be greater than about 0.115 inches (e.g., 0.116 inches), and the density of the projectile 10 (e.g., the core 24) may be greater than 12 to 14 grams per cubic centimeter.

The projectile 10 according to the present disclosure is designed to exhibit a 10-shot group dispersion of approximately 1.0 inch or less extreme spread at 100 yards. For example, some embodiments may be configured to exhibit a 10-shot group accuracy at 100 yards of 0.95 inches, 0.92 inches, or 0.90 inches. Some embodiments of the projectile 10 may be configured to exhibit a velocity at 900 yards of at least about 2,000 feet per second (fps). For example, the projectile 10 may be configured to exhibit a velocity at 900 yards of at least about 2,050 fps, 2,100 fps, or 2,150 fps. In addition, the projectile 10 further may be configured to exhibit a kinetic energy at 900 yards of at least about 1,400 foot-pounds (ft-lbs). For example, some embodiments of the projectile will be configured to exhibit a kinetic energy at 900 yards of at least about 1,450 ft-lbs, 1,500 ft-lbs, 1,525 ft-lbs, or 1,550 ft-lbs, for example, depending on the weight and/or diameter of the projectile 10.

In some embodiments, the configuration of the jacket 12 and/or the jacket meplat 29 of the projectile 10 will cause the jacket 12 to deform or mushroom upon impact and entry into the targeted game, sufficient to quickly create an initial yaw effect (e.g., almost instantly on impact), so that the size of the wound cavity is increased and/or vital organs of the targeted game are disrupted. The scoring of at least one core section 26 helps promote fragmentation of the at least one scored core section 26, and also can help facilitate the separation of at least some of the core sections 26 from the other core sections 26. Such fragmentation and separation can result in the creation of additional wound channels extending away from the primary wound cavity, thereby further increasing the likelihood of substantially immediately incapacitating the targeted game. In some embodiments, the projectile 10 may be configured to be fired from firearms having a barrel with a standard rifling twist. In some embodiments, the projectile 10 may provide a relatively heavier projectile that will stabilize in standard twist barrels.

According to some embodiments and as illustrated in FIGS. 11-15, the projectile 10 may be configured to exhibit an initial yaw of about 0.01 inches to about 2.0 inches (e.g., about 0.75 inches to about 2.0 inches) at 900 yards upon entry into a gel block or media simulating game. Thereafter, the projectile 10 may be exhibit a point of divergence of less than about 2.5 inches at 900 yards. For example, some embodiments may exhibit a point of divergence of less than about 2 inches, or less than about 1 inch. The point of divergence is the distance after entry of the projectile into an animal at which the projectile begins to fragment (e.g., the jacket and/or the core begins to separate from the main mass of the projectile).

Figure 2:
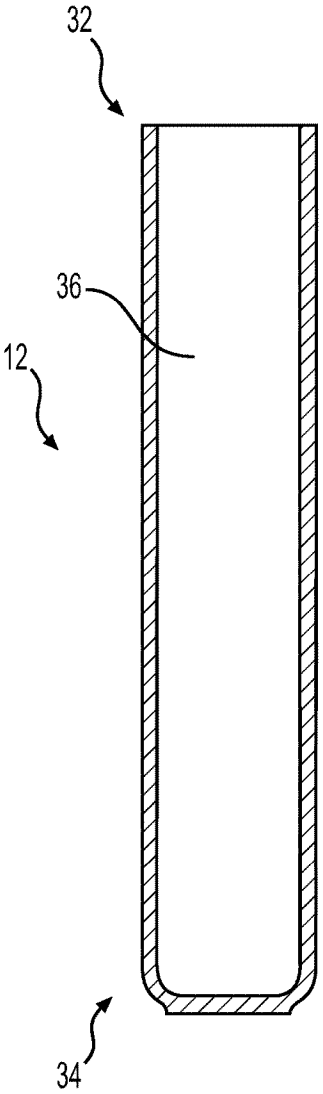
FIG. 2 is a section view of an example of an empty cylindrical jacket configured according to embodiments of the present disclosure.

FIG. 2 is an illustration of an example embodiment of a jacket 12 configured for use in forming the projectile 10 according to some embodiments. The empty jacket 12 initially can be formed as a cylinder or tube with an open forward or first end 32 and a closed opposite, second end or base 34, with a substantially cylindrical cavity 36 defined therein and in which the core 24 is received. Some embodiments of the jacket 12 may be drawn from a metal cup and trimmed to an appropriate length to achieve a desired projectile and jacket configuration. The jacket 12 also may be sized and configured to achieve any intended caliber, such as the calibers mentioned previously herein.

Figure 3:
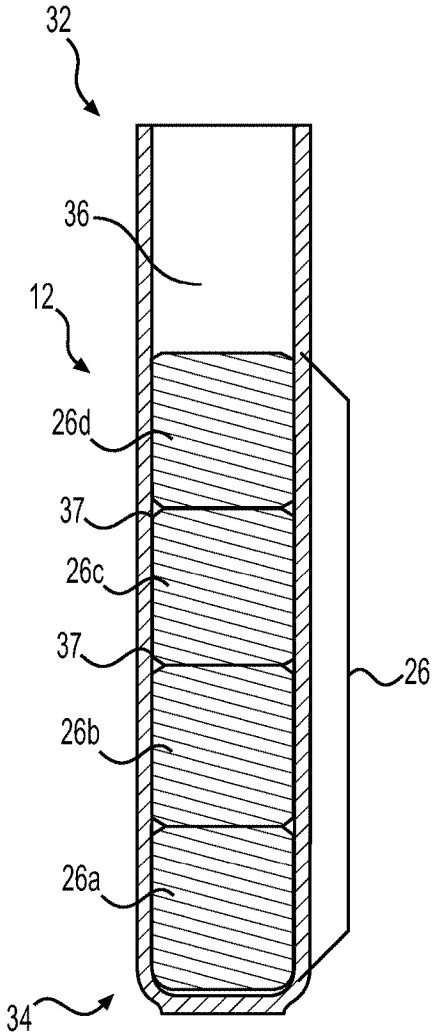
FIG. 3 is a section view of the metal jacket of FIG. 2 after a plurality of core sections have been received in the jacket.

FIG. 3 illustrates the jacket 12 shown in FIG. 2 with a plurality of core sections 26 (e.g., core sections **26*a*-26*d*) received in the cylindrical cavity 36 defined by the wall 14 of the jacket 12 for forming the core 24. Although the example shown in FIG. 3 includes four core sections 26*a*-26*d***, other numbers of core sections are contemplated, such as fewer or more core sections.

At least one of the plurality of core sections 26 will be formed from one or more high density, lead-free materials (e.g., substantially or completely lead-free materials) to provide a "green" core 24 with an increased density. For example, one or more of the core sections 26 will be formed from a combination of tungsten powder and lead-free binder material pressed into a substantially cylindrical form and thereafter sintered. The tungsten powder serves to provide a relatively high density core section and core, helping to increase the ballistic coefficient of the projectile 10, and/or help increase the kinetic energy of the projectile 10 down range as compared to lower BC projectiles of similar weight and diameter (and/or increase projectile stability at relatively slower twist rates) when fired from a firearm or other launch apparatus. The lead-free binder material may serve to increase the strength of the core sections and/or the malleability (and/or formability) of the core sections 26.

A rotary press (or other type of press) may be used to press the powder mixture into the pre-sintered core section form. Although the core sections 26 shown in FIG. 3 are substantially cylindrical in configuration, other configurations are contemplated. As also indicated in FIG. 3, the core sections 26 are each pressed into a substantially cylindrical configuration, generally a right cylinder having a radiused or chamfered edge 37, which can help prevent corners of the core sections 26 from chipping or separating from the remainder of the core section 26, for example, prior to sintering. In some embodiments, one or more of the core sections 26 may not include a radiused or chamfered edge.

The high density compacted mixture forming the core sections 26 also can include small amounts of a lubricant/binder, such as lithium stearate powder, mixed with the tungsten powder and lead-free binder material, the mixture of which may be pressed into the substantially cylindrical shape of the pre-sintered core sections 26 and thereafter sintered.

The lubricant/binder may serve as a deoxidizer for the combination of the tungsten powder and the lead-free binder material, which may result in an improved bonding between the tungsten powder particles and the lead-free binder material when the core sections are sintered. The lubricant/binder may render it relatively easier to remove the pressed core sections from a press and/or die used to press the powders into the core section configurations. In some instances, the lubricant/binder also may serve to help maintain the homogeneity of the mixture of tungsten and lead-free binder material, which improves the consistency of forming the core sections and in some instances, promotes the weight balance of the core, which helps maintain dispersion and/or accuracy of the projectile 10. Some embodiments of the core sections, prior to sintering, may be pressed to a first density of about 11 to 13 grams per cubic centimeter.

For some embodiments of the core sections 26, the tungsten powder may comprise from about 25 wt. % to about 95 wt. % (e.g., from about 50 wt. % to about 95 wt. %) of the core section 26. For example, the tungsten powder may comprise from about 75 wt. % to about 95 wt. %, or from about 85 wt. % to about 95 wt. % of the core section 26. In some embodiments of the core section 26, the lead-free binder material may comprise from about 2 wt. % to about 75 wt. % (e.g., from about 5 wt. % to about 50 wt. %) of the core section 26. For example, the lead-free binder may comprise from about 5 wt. % to about 75 wt. %, or from about 10 wt. % to about 65 wt. % of the core section 26. For embodiments of core section 26 including lubricant/binder, the lubricant/binder may comprise from about 0.01 wt. % to about 5.0 wt. % (e.g., from about 0.1 wt. % to about 2.0 wt. %) of the core section 26. For example, the lithium stearate powder may comprise from about 0.2 wt. % to about 0.6 wt. % of the core section 26.

For some embodiments of the core sections 26, the particle size, shape, and/or morphology of the powders may be selected to enhance powder mixture homogeneity, promote consistency of the weight of the core sections 26, increase the green strength of the core section 26 (e.g., the strength prior to sintering), and/or increase porosity of the core sections 26. For example, the tungsten powder may have a median particle size $d_{50}$ ranging from about 625 mesh to about 10 mesh, from about 500 mesh to about 20 mesh, from about 325 mesh to about 40 mesh, from about 200 mesh to about 100 mesh, or from about 170 mesh to about 140 mesh (e.g., about 150 mesh). For example, the tungsten powder may have a median particle size $d_{50}$ of at least about 50 mesh, and in some embodiments, the tungsten powder may have a median particle size $d_{50}$ of at least about 45 mesh, at least about 40 mesh, at least about 35 mesh, or at least about 30 mesh. In addition, at least about 95% (e.g., at least about 98.5%) of the tungsten particles have a particle size greater than about 230 mesh, and in other embodiments, at least about 95% of the tungsten particles may have a particle size greater than about 200 mesh, at least about 170 mesh, or at least about 140 mesh.

The lead-free binder material may include a powder of one or more other materials, and the powder may have a median particle size $d_{50}$ of at least about 170 mesh. For example, the lead-free binder material may have a median particle size $d_{50}$ ranging from about 625 mesh to about 10 mesh, from about 400 mesh to about 20 mesh, from about 250 mesh to about 25 mesh, from about 120 mesh to about 30 mesh, or from about 60 mesh to about 35 mesh (e.g., about 40 mesh). For example, the lead-free binder material powder may have a median particle size $d_{50}$ of at least about 150 mesh, at least about 120 mesh, or at least about 100 mesh.

In some embodiments, the lead-free binder material may include a powder or particles. In some embodiments, a ratio of the median particle size of the tungsten powder to the median particle size of the lead-free binder material may range from about 1:1 to about 8:1 (e.g., from about 3:1 to about 5:1). Some embodiments of the tungsten powder and/or the lead-free binder material may have a mono-modal particle size distribution, for example, such that the respective particle size distribution has a single peak, or a multi-modal particle size distribution, for example, such that the respective particle size distribution has more than a single peak (e.g., two peaks). For example, the lead-free binder material may be multi-modal and have a combination of a first particle size distribution, such that the median particle size $d_{50}$ is 150 mesh and a second particle size distribution, such that the median particle size $d_{50}$ is 625 mesh. Such embodiments may aid with increasing or decreasing the density and/or strength of the core sections 26 and/or assist with the homogeneity of the combination of the tungsten powder and lead-free binder material powder.

In some embodiments, the combination of the tungsten powder particle size and the lead-free binder material particle size may result in the tungsten particles and lead-free binder material particles interacting with each other, such that the lead-free binder material particles are suspended among the tungsten particles. This may increase the green strength of the pressed and pre-sintered core sections 26. In some embodiments, the larger tungsten particles relative to the lead-free binder material particles may result in the pressed, pre-sintered core sections 26 being relatively porous.

The lubricant/binder may have a median particle size $d_{50}$ ranging from at least about 14 micrometers to about 1 micrometer, from at least about 10 micrometers to about 2 micrometers, from at least about 7 micrometers to about 3 micrometers, or from at least about 6 micrometers to about 4 micrometers. In some examples, the lubricant/binder may have a median particle size $d_{50}$ of less than about 14 micrometers, less than about 12 micrometers, less than about 10 micrometers, less than about 8 micrometers, or less than about 6 micrometers.

Some embodiments of the pre-sintered core sections 26 may have a relatively low aspect ratio, defined as the ratio of the height or length of the core section 26 relative to the diameter or thickness of the core section 26. This may result in increasing the green strength of the core section 26, reducing the pressing force to form the core section 26, increasing the porosity of the core section 26, and/or providing core sections 26 having a more homogeneous density. In some embodiments, at least some of the plurality of core sections 26 (e.g., all the core sections 26) have substantially the same size, substantially the same shape, and/or substantially the same composition. The size, shape, and/or composition of the core sections 26 may be chosen depending at least partially on the application or intended use of the projectile.

Once the core sections 26 have been formed by pressing the powder mixture into the substantially cylindrical form, the core sections 26 may be sintered to increase the strength and/or toughness of the core sections 26. For some embodiments of the core sections 26, sintering the core sections 26 may result in the lead-free binder material particles sintering to one another and surrounding the tungsten particles, which may hold the tungsten particles together via diffusion bonds. This may result in the controlled frangibility of the core sections 26 and core 24 for relatively short range performance (e.g., about 100 yards) through relatively long-range performance (e.g., about 900 yards or more). The sintering also may remove (e.g., burn-off) oxides and lubricants/binders present in the powder mixture and/or may increase or help control the strength and/or toughness of the core sections 26.

Some embodiments may include sintering the core sections 26 prior to being received in the jacket 12. In such embodiments, the core sections 26 may be sintered and thereafter received in the jacket 12, before, during, or after cooling of the sintered core sections 26. Other embodiments may include sintering the core sections 26 after the core sections have been received within in the jacket 12, which may facilitate maintaining jacket/core integrity.

For some embodiments, the sintering may include heating the core sections 26 at a time and/or temperature sufficient to achieve a desired bond strength. For example, the sintering may include heating the core sections 26 in an atmosphere comprising at least about 3 wt. % hydrogen and less than about 98 wt. % nitrogen at a temperature ranging from at least about 300° Fahrenheit (F) to about 3,500° (e.g., from about F 900° F. to about 2,200° F.) for at least about 45 minutes, depending, for example, on the melting temperature of the lead-free binder. In some embodiments, the atmosphere may comprise from about 3 wt. % to about 85 wt. % hydrogen and from about 15 wt. % to about 97 wt. % nitrogen. In some examples, the sintering time may be reduced, for example, if the core sections are sintered in an induction or open air vacuum. For example, the core sections 26 may be sintered for a time ranging from about 1 minute about 45 minutes in an induction or open air vacuum. In some examples, if the core sections 26 are sintered in a belt furnace, the sintering time may be about 45 minutes or more.

The sintering may occur during more than one time period at different conditions during each time period. For example, the core sections can be sintered for a first time period ranging from about 0.1 minutes to about 120 minutes (e.g., from about 7 minutes to about 15 minutes (e.g., from about 10 minutes to about 15 minutes or from about 11 minutes to about 12 minutes)), with sintering done at about 300° F. or greater, at about 1,000° F. or greater, or upwards of at least about 1,200° F. or greater, for example, depending on the melting temperature of the lead-free binder for example, with the sintering occurring below the melting temperature. For a second time period (e.g., immediately following the first time period), the sintering may occur for a time period ranging from about 0.1 minutes to about 120 minutes (e.g., from about 40 minutes to about 60 minutes, from about 45 minutes to about 55 minutes, or from about 45 minutes to about 50 minutes), and can be conducted at about 1,400° F. or greater. For example, during the second time period, the sintering may occur at about 1,400° F. to about 1,600° F. or greater, but not exceeding a melting temperature of the core mixture, for example, to upwards of at least about 2,100° F. or greater, for example, depending on melting temperature of the lead-free binder material. In some examples, the sintering may occur prior to swaging, and in some examples, the sintering may occur after swaging.

FIG. 4 shows a perspective view of the first end 16 of an embodiment of the projectile 10 in which the tip 30 and a portion of the ogive portion 18 have been removed to reveal that one of the core sections 26 has been scored to create an example scoring 38. As shown in FIG. 4, the scoring 38 may be on an end face 40 of the core section 26 proximate the first end 16 of the projectile 10 (e.g., the core section 26*d* shown in FIGS. 1 and 3). The example shown in FIG. 4 includes a cross-shaped scoring 38. Other configurations of scoring 38 are contemplated. More than one of the core sections 26 may be scored.

Some embodiments of the scoring 38 may promote fragmentation of one or more of the core sections 26, for example, as described herein. For example, the scoring 38 may create small fractures in the surface of the core section 26 (e.g., at the end surface and/or down the sides of the core section 26). Upon impact with a target, the scoring may cause fragmentation of one or more of the core sections 26 (e.g., the core section 26*d*), creating irregular shaped fragments, which may induce the core sections 26 to yaw and separate from one another. This may promote yaw of the projectile 10 upon impact with the target or within a relatively short distance after impact.

FIG. 5A and FIG. 5B show perspective views of respective example core sections 26 including a plurality of core sectors 27 according to embodiments of the present disclosure. As shown in FIGS. 5A and 5B, in some embodiments, one or more of the core sections 26 may include a plurality of core sectors (e.g., right cylindrical sectors). For example, in embodiments, as shown in FIG. 5A, each core section 26*a* and 26*b* can include three core sectors 27*a*, 27*b*, and 27*c*, and in FIG. 5B, each core section 26*a* and 26*b* includes four core sectors 27*a*, 27*b*, 27*c*, and 27*d*. As shown in FIG. 5A, one or more of the core sectors 27*a*-27*c* of the respective core sections 26*a* and 26*b* may be substantially circumferentially aligned. As shown in FIG. 5B, one or more of the core sectors 27*a*-27*d* of the respective core sections 26*a* and 26*b* may be circumferentially offset.

Although the embodiments shown in FIGS. 5A and 5B each include two core sections 26*a* and 26*b*, fewer (i.e., one) or more than two core sections 26 are contemplated. Further, although the embodiments shown in FIGS. 5A and 5B include three and four core sectors 27*a*-27*c* and 27*a*-27*d*, respectively, one or more of the core sections 26 may have fewer or more core sectors than others of the core sections 26. Although each of the core sections 26*a* and 26*b* shown in FIGS. 5A and 5B includes an equal number of core sectors, one or more of the core sections 26*a* and/or 26*b* may include a different number of core sectors. Although each of the core sections 26*a* and 26*b* shown in each of FIGS. 5A and 5B includes equal-size core sectors (e.g., having the same length and the same included angle defining the respective core sectors), the core sectors of a core section 26 may have different sizes (e.g., different lengths and/or different included angles). Core sectors having geometric shapes other than cylindrical sectors are contemplated. The core sections can also be scored into the core and not necessarily be separate sections. In some embodiments, one or more of the core sections 26 and/or one or more of the core sectors may be formed, for example, as described herein. In some embodiments, the core sectors may promote a relatively more rapid expansion of the core sections 26 in a target upon entry and/or a relatively more rapid energy transfer to the target upon entry.

Figure 6:
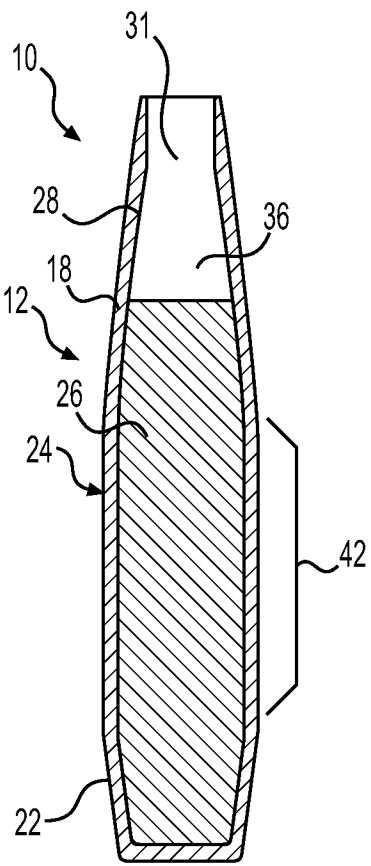
FIG. 6 is a sectional view of the jacket and plurality of core sections received therein, as shown in FIG. 3, following swaging of the jacket to create an example ogive portion, boat tail, and compressed core formed from the plurality of core sections.

FIG. 6 is a section view of the embodiment shown in FIG. 3 following swaging of the jacket 12 to create the ogive portion 18, boat tail 22, and core 24, as compressed, for example, during the swaging process. The swaging may help increase the density of the core 24 and/or one or more of the core sections 26 via a radial forging of the core sections 26 proximate the region of the ogive portion 18 and/or the boat tail 22. For example, the core 24 and/or one or more of the core sections 26 via a radial forging of the core sections 26 may have a density of at least about 12 to 14 grams per cubic centimeter. Proximate a region intermediate the ogive portion 18 and the boat tail 22, the core 24 and/or core sections 26 may be swaged out at a shank section 42 of the core 24.

Figure 7:
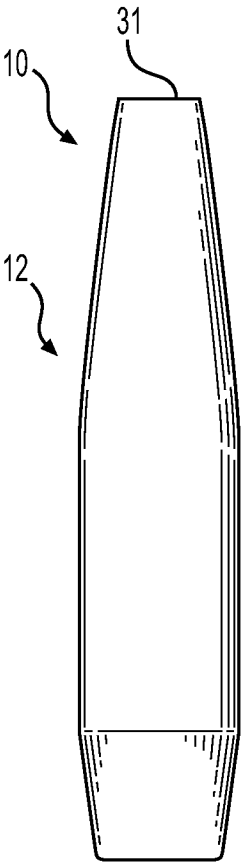
FIG. 7 is a side view of a projectile shown in FIG. 6.

FIG. 7 is a side view of the embodiment of projectile 10 shown in FIG. 6, and FIG. 8 is a partial section view of the projectile 10 revealing the jacket mouth 28 and an example tip 30 received in the cavity 31 defined within the first end 32 of the jacket 12 in front of the jacket mouth 28. In some embodiments, the tip 30 may be preformed, and the jacket meplat 29 of the jacket 12 may be formed around the tip 30. The tip 30 may serve to reduce the aerodynamic drag of the projectile 10 and/or increase the ballistic coefficient. The tip 30 may be formed from a polymer or plastic, metal, or other, similar materials. The jacket meplat 29 may be configured to assist with causing the jacket 12 to deform or mushroom upon entry into the target, quickly creating an initial yaw effect, so that the size of the wound cavity is increased and/or so that the position of the wound cavity may start or be moved toward the point of entrance of the projectile into the target and/or having more of the wound cavity in the target. FIG. 9 is a side view of the embodiment of projectile 10 shown in FIG. 8 without a section of the jacket 12 removed. In some examples, the projectile 10 may not include a tip.

FIG. 10 is a side section view of an embodiment of a cartridge 44 with a projectile 10, such as shown in FIG. 1. The cartridge 44 may be sized for use in a standard firearm of a matching caliber, with a standard twist barrel (e.g., an SAAMI standard twist in accordance with SAAMI for SAAMI cartridges or a CIP standard twist in accordance with CIP for CIP cartridges) (e.g., without requiring use of customized firearms/barrels), and may be produced using the projectile 10 according to embodiments described herein. As shown in FIG. 10, the projectile 10 may be combined or received within the open front end of the casing 46, in front of a propellant charge. The cartridge 44 also will include a primer 50 at its second, rear end or base. Any length of the casing 46 is contemplated, and the length of the casing 46 shown in FIG. 10 is merely an example.

FIGS. 11-15 show views of tests conducted using exemplary projectiles formed according to the present disclosure. The figures illustrate the formation of temporary and permanent wound cavities by projectiles formed according to the principles of the present disclosure, at simulated distances of 100 yards and 900 yards, fired at blocks of ballistic gel (i.e., measuring 8 inches×8 inches×24 inches).

Figure 11:
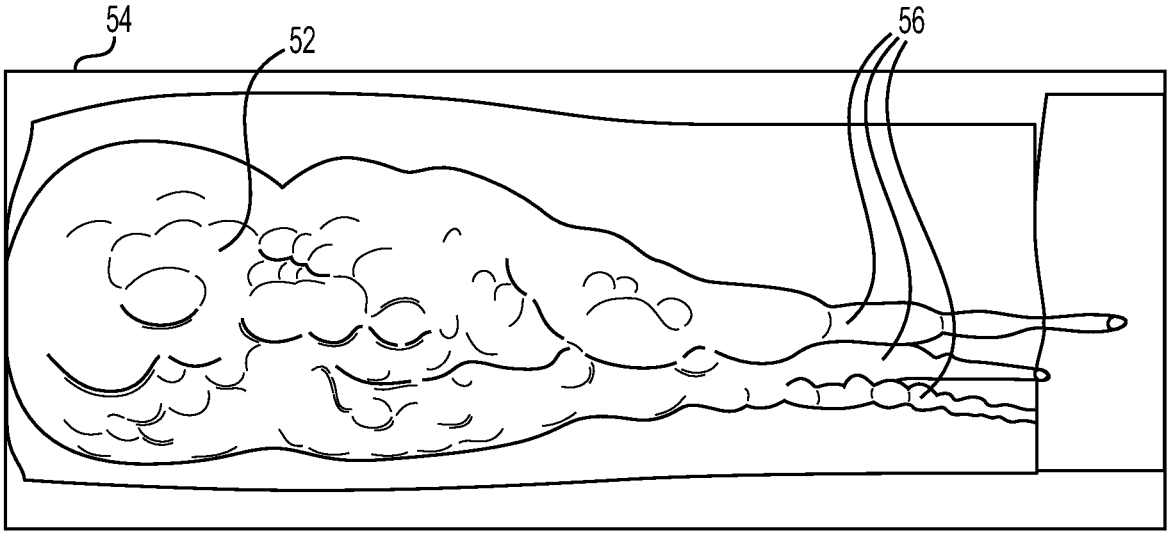
FIG. 11 shows a side view of a typical temporary cavity created by a projectile consistent with at least some embodiments fired from a range of 100 yards into 10% ballistics gelatin.

FIG. 11 shows a side view of a typical temporary cavity 52 created in an example target 54 by a projectile 10 consistent with at least some embodiments described herein fired from a range of 100 yards. As the projectile 10 strikes the target 54 at the left-hand side, the large temporary cavity 52 is initially created. In some embodiments, the configuration of the jacket 12 and/or the jacket meplat 29 may cause the jacket 12 to deform or mushroom upon entry into the target 54, quickly creating an initial yaw effect, so that the size of the temporary cavity 52 is increased and moved toward the point of target impact. The scoring 38 of one or more of the core sections 26 promotes fragmentation of the core 24, followed by separation of at least some of the core sections 26 from one another. As shown in FIG. 11, such fragmentation and separation may result in the creation of wound channels 56 extending away from the temporary cavity 52.

Figure 12:
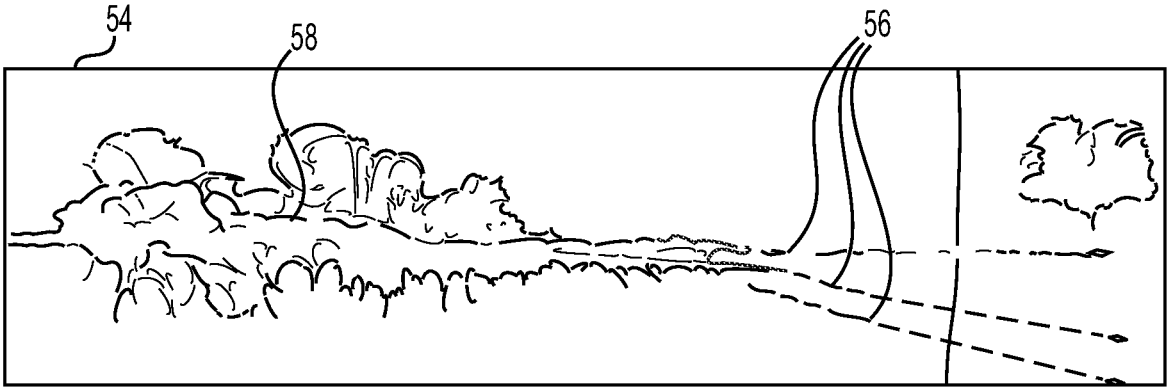
FIG. 12 shows a side view of a typical permanent cavity created by the projectile fired in FIG. 10 from a range of 100 yards into 10% gelatin.
Figure 13:
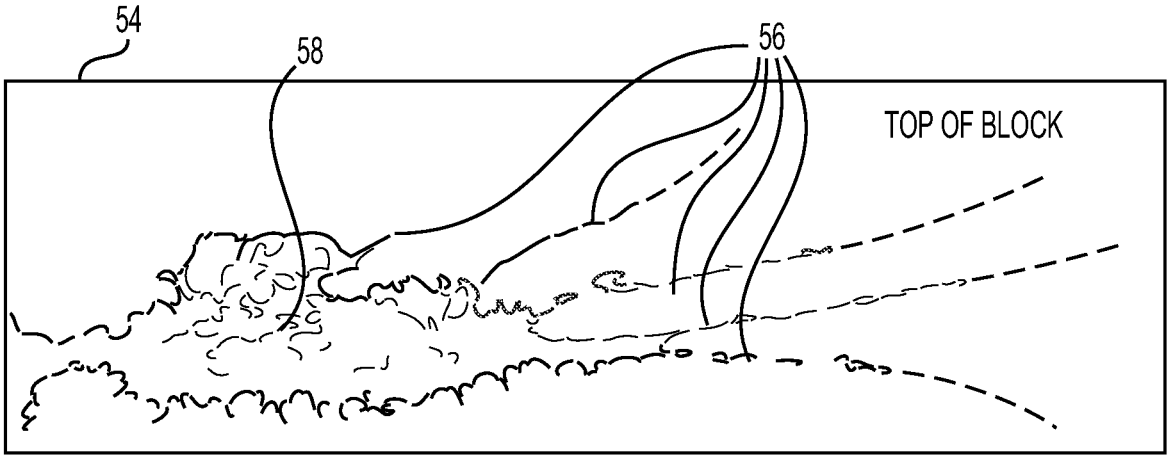
FIG. 13 shows a top view of the typical permanent cavity shown in FIG. 12 showing a dispersion of core sections.

FIG. 12 shows a side view of a typical permanent cavity 58 created by the projectile 10 fired in FIG. 11 from a range of 100 yards. As shown in FIG. 12, the initial yaw of the projectile 10 occurs a short distance after entry into the target 54, and the fragmenting of the jacket 12 and/or the core 24 creates the large permanent cavity 58. The fragmentation of the core 24, for example into fragments induced by the scoring 38 and/or separation of the core sections 26 from one another, creates the channels 56. FIG. 13 shows a top view of the typical permanent cavity 58 shown in FIG. 12, confirming the permanent cavity 58 and channels 56 formed by the separation of the core sections.

Figure 14:
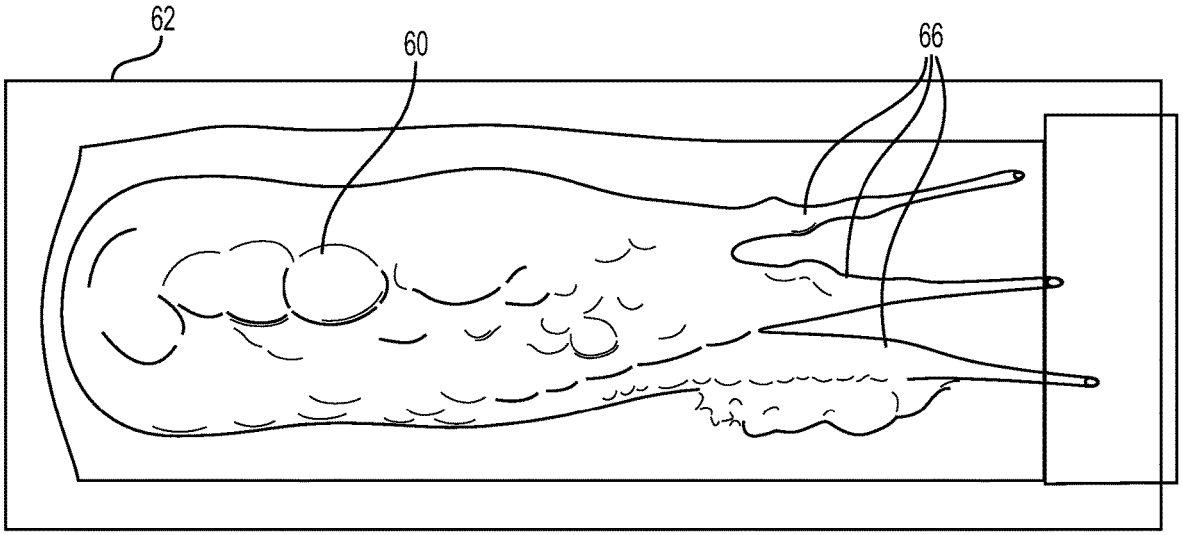
FIG. 14 a side view of a typical temporary cavity created by a projectile consistent with at least some embodiments fired from a range of 900 yards.

FIG. 14 a side view of a typical temporary cavity 60 created by a projectile 10 consistent with at least some embodiments fired from a range of 900 yards. Similar to FIG. 11, as the projectile 10 strikes the target 62 at the left-hand side, a large temporary cavity 60 is initially created. This confirms that the projectile 10, at least in some embodiments, has sufficient kinetic energy and terminal function/performance at a range of 900 yards to substantially repeat the effects shown in FIGS. 11-13 at a range of 100 yards.

Figure 15:
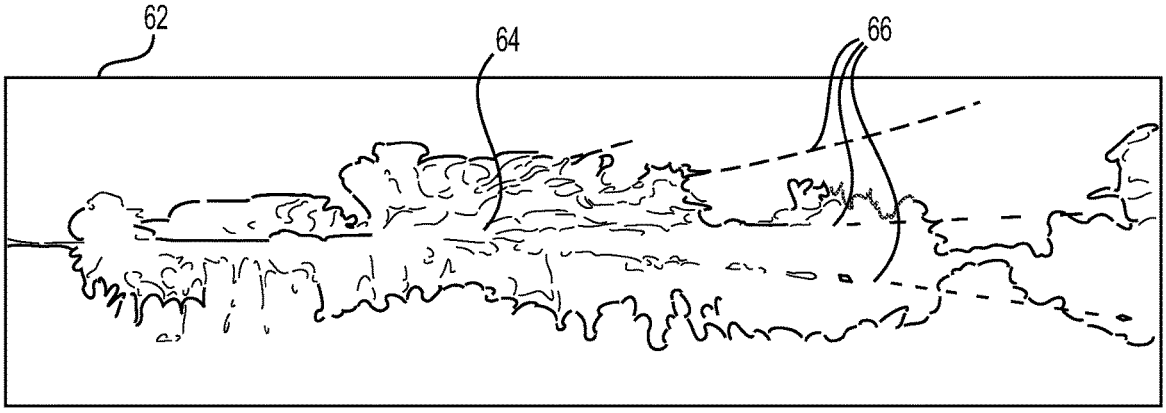
FIG. 15 shows a side view of a typical permanent cavity created by the projectile fired in FIG. 13 from a range of 900 yards.

FIG. 15 shows a side view of a typical permanent cavity 64 created by the projectile 10 fired in FIG. 14. In some embodiments, the configuration of the jacket 12 and/or the jacket meplat 29 may cause the jacket 12 to deform or mushroom upon entry into the target 62, quickly creating an initial yaw effect, so that the size of the temporary cavity 60 is increased, as well as the size of the permanent cavity 64, which is moved toward the point of impact. The scoring 38 of one or more of the core sections 26 promotes fragmentation of the core 24, followed by separation of at least some of the core sections 26 from one another. As shown in FIGS. 14 and 15, such fragmentation and separation may result in the creation of channels 66 extending away from the temporary cavity 60 and the permanent cavity 64.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A projectile comprising:

a jacket comprising a wall having a first end and a second end opposite the first end; and a core formed from at least one core section, the at least one core section comprising tungsten powder and a binder pressed and sintered to form a substantially cylindrical shape, wherein the at least one core section is received in the jacket with a first end of at least one core section including a weakened area formed therein; and wherein the binder comprises a lead-free metallic material that remains as a part of the core after sintering.

2. The projectile of claim 1, wherein the wall of the jacket defines a substantially cylindrical hollow cavity in which the at least one core section is received.

3. The projectile of claim 1, wherein the tungsten powder comprises from about 25 wt. % to about 98 wt. % of the at least one core section, and the lead-free metallic binder comprises about 2.0 wt. % to about 75.0 wt. % of the at least one core section.

4. The projectile of claim 1, at least about 95% of the tungsten powder comprises particles having a median particle size of at least about 625 mesh.

5. The projectile of claim 1, wherein the lead-free metallic binder comprises copper, aluminum, tin, nickel, zinc, iron, gold, silver, carbon steel, alloyed steel, stainless steel, antimony, etc., or a mixture or alloy of such materials, and/or brazing filler materials, such as silicon, boron, phosphorus, palladium, cobalt, cadmium, bismuth, beryllium, chromium, manganese, molybdenum, indium, carbon, germanium, mischmetal, cerium, strontium, lithium, zirconium, hafnium, vanadium, sulfur, titanium, or combinations thereof.

6. The projectile of claim 1, further comprising a tip formed at the first end of the jacket.

7. The projectile of claim 1, wherein the jacket further comprises an open cavity defined at the first end thereof.

8. The projectile of claim 7, further comprising a tip received within the open cavity defined in the first end of the jacket.

9. The projectile of claim 1, wherein the weakened area comprises a pattern of scoring or one or more cuts formed in the first end of the at least one core section.

10. The projectile of claim 1, further comprising a lubricant/binder configured to act as a deoxidizer.

11. The projectile of claim 1, wherein the at least one core section comprises a ratio of a median particle size $d_{50}$ of the tungsten powder to a median particle size $d_{50}$ of the lead-free binder of about 1:1 to about 8:1.

12. The projectile of claim 1, wherein the at least one core section is compressed inside the jacket, thereby increasing a density of the at least one core section.

13. The projectile of claim 1, wherein the projectile has a ballistic coefficient ranging from about 0.13 to about 0.80.

14. The projectile of claim 1, wherein the jacket includes a meplat and formed adjacent a first end of the jacket, and a mouth defined at an end of the meplat, wherein the mouth comprises an internal diameter of approximately 0.115 inches or greater.

15. The projectile of claim 1, wherein the at least one core section comprises a plurality of stacked core sections; wherein one or more of the core sections of the plurality of core sections comprises at least one radiused or chamfered edge at least one end thereof.

16. A method for making a projectile, the method comprising:

combining tungsten powder and lead-free binder material to form a core mixture; pressing the core mixture into a plurality of core sections;

placing the plurality of core sections into a jacket and sintering the plurality of core sections or sintering the plurality of core sections and thereafter placing them into the jacket; and swaging the jacket with the plurality of core sections received therein and compressing at least one core section of the plurality of core sections within the jacket;

wherein the projectile has a ballistic coefficient ranging from about 0.13 to about 0.80.

17. The method of claim 16, wherein the core mixture comprises from about 25 wt. % to about 98 wt. % of the tungsten powder and from about 2 wt. % to about 75 wt. % of the lead-free binder material.

18. The method of claim 16, further comprising mixing a lubricant/binder with the tungsten powder and the lead-free binder material, wherein the lubricant/binder comprises from about 0.01 wt. % to about 5.0 wt. % of the core mixture.

19. The method of claim 18, wherein after pressing the core mixture into a plurality of core sections, the plurality of core sections comprises a first density, and wherein after swaging the jacket and compressing the at least one core section of the plurality of core sections, the at least one core section comprises a second, increased density that is greater than first density.

20. The method of claim 16, wherein the tungsten powder has a median particle size $d_{50}$ ranging from about 625 mesh to about 10 mesh, the lead-free binder comprises a median particle size $d_{50}$ ranging from about 625 mesh to about 10 mesh.

21. The method of claim 16, wherein the lead-free binder material comprises one or more of lead-free binder powder.

22. The method of claim 16, wherein sintering the plurality of core sections comprises sintering the core sections for a first time period ranging from about 0.1 minutes to about 60 minutes at a first temperature of at least about 300 degrees ° F.

23. The method of claim 22, further comprising sintering the core sections for a second time period following the first time period, ranging from about 0.1 minutes to about 120 minutes at a second temperature of at least about 1,400 degrees ° F. not to exceed a melting temperature of the core mixture.

24. The method of claim 16, wherein swaging the jacket and compressing the at least one of the plurality of core sections comprises pressing a forward end of the jacket into an ogive shape defining a jacket meplat.

25. The method of claim 16, wherein swaging the jacket comprises forming an ogive and a tip at a forward end of the jacket and a boat tail at a rearward end of the jacket.

26. The method of claim 16, further comprising forming a pattern of scoring or cuts at a forward end of the one of the plurality of core sections.

27. A projectile comprising:

a jacket comprising a wall having a first end and a second end opposite the first end and defining a cavity; and a core comprising a plurality of core sections received within the cavity of the jacket an end-to-end relationship, each core section of the plurality of core sections comprising a tungsten powder pressed and sintered with a lead free binder to form a substantially cylindrical shape;

wherein jacket is swaged about the plurality of core sections such that the plurality of core sections are swaged and compressed;

wherein prior to swaging, the core comprises a first density, and after swaging the jacket and compressing the plurality of core sections of the core, core comprises a second, increased density that is greater than first density.

28. The projectile of claim 27, wherein the projectile has a ballistic coefficient ranging from about 0.13 to about 0.80.

29. The projectile of claim 27, wherein the tungsten powder comprises from about 25 wt. % to about 98 wt. % of each of plurality of core sections and has a median particle size of at least about 625 mesh; and the lead-free binder comprises about 2.0 wt. % to about 75.0 wt. % of the at least one core section and has a median particle size of at least about 625 mesh.

30. The projectile of claim 27, wherein the core further comprises a lubricant/binder mixed with the tungsten powder and the lead-free binder, wherein the lubricant/binder comprises from about 0.01 wt. % to about 5.0 wt. % of the core.

31. A projectile comprising:

a jacket comprising a wall having a first end and a second end opposite the first end and defining a cavity; and a core comprising tungsten powder, a lead-free metallic binder, and a lubricant or additional binding agent, pressed and sintered with the tungsten powder such that particles of the tungsten powder are bound together with the lead-free metallic binder to form the core and at least a portion of the lubricant or binding agent is removed;

wherein the core comprises a first end including a weakened area formed therein, the weakened area comprising a pattern of scoring or one or more cuts configured to form stress concentrations in the first end to promote fragmentation and separation of the core into a plurality of core sections.

32. The projectile of claim 31, wherein the projectile has a ballistic coefficient ranging from about 0.13 to about 0.80.

33. The projectile of claim 31, wherein at least some of the plurality of core sections move along separate paths upon impact of the projectile.

34. The projectile of claim 31, wherein the projectile further comprises a tip.

* * * * *